US009315295B2

(12) United States Patent
Deev et al.

(10) Patent No.: US 9,315,295 B2
(45) Date of Patent: Apr. 19, 2016

(54) EASY OPENING ENVELOPE

(71) Applicants: Artem Deev, Fulham Gardens (AU); Alexey Deev, Fulham Gardens (AU)

(72) Inventors: Artem Deev, Fulham Gardens (AU); Alexey Deev, Fulham Gardens (AU)

( * ) Notice: Subject to any disclaimer, the term of this patent is extended or adjusted under 35 U.S.C. 154(b) by 0 days.

(21) Appl. No.: 14/361,799

(22) PCT Filed: Oct. 18, 2012

(86) PCT No.: PCT/AU2012/001264

§ 371 (c)(1),
(2) Date: May 30, 2014

(87) PCT Pub. No.: WO2013/120125

PCT Pub. Date: Aug. 22, 2013

(65) Prior Publication Data

US 2015/0083790 A1 Mar. 26, 2015

(30) Foreign Application Priority Data

Feb. 15, 2012 (AU) ..... 2012900548

(51) Int. Cl.
*B65D 27/34* (2006.01)
*B65D 27/14* (2006.01)

(52) U.S. Cl.
CPC ..... *B65D 27/34* (2013.01); *B65D 27/14* (2013.01)

(58) Field of Classification Search
CPC ..... B65D 27/34; B65D 27/38
USPC ..... 229/81, 314, 313, 316
See application file for complete search history.

(56) References Cited

U.S. PATENT DOCUMENTS

| | | | | | |
|---|---|---|---|---|---|
| 211,725 | A | * | 1/1879 | Foster | 229/75 |
| 484,733 | A | * | 10/1892 | Flynn | 229/309 |
| 1,328,028 | A | * | 1/1920 | Ahana | 229/311 |
| 1,957,684 | A | * | 5/1934 | Will | 229/312 |
| 2,335,470 | A | * | 11/1943 | Alland | 229/314 |
| 2,345,793 | A | * | 4/1944 | Chapel | 229/67.1 |

(Continued)

FOREIGN PATENT DOCUMENTS

| | | |
|---|---|---|
| CA | 2 187 509 A1 | 8/1996 |
| DE | 29806558 U1 | 8/1998 |

(Continued)

OTHER PUBLICATIONS

International Search Report and Written Opinion for Application No. PCT/AU2012/001264; dated Nov. 26, 2012.

(Continued)

*Primary Examiner* — Jes F Pascua
*Assistant Examiner* — Derek Battisti
(74) *Attorney, Agent, or Firm* — Alston & Bird LLP

(57) ABSTRACT

An easy opening envelope comprising a front panel (38) and a rear panel (20), each having an upper edge, a lower edge and opposing side edges; a sealing flap (26) connected to the upper edge (22) of the front panel (38); an adhesive strip (28) extending longitudinally across the envelope on one of the sealing flap (26) or the rear panel (20) of the envelope. A continuing line of perforations (32), (34), (36) extending across a corner of the sealing flap (30), the front panel (38) and a side fold line on the side edge (24). Whereby, once the envelope is sealed, by pulling on an edge of the corner section of the sealing flap (30) and following the continuing line of perforations (32), (34), (36) the envelope can be easily opened and the content of the envelope can be conveniently removed.

10 Claims, 6 Drawing Sheets

(56) References Cited

U.S. PATENT DOCUMENTS

| | | | | | |
|---|---|---|---|---|---|
| 3,104,048 | A | * | 9/1963 | Lemiesz | 229/311 |
| 3,243,099 | A | * | 3/1966 | Winegard | 383/78 |
| 5,505,376 | A | | 4/1996 | Kent et al. | |
| D377,191 | S | * | 1/1997 | Thompson | D19/3 |
| 5,961,436 | A | | 10/1999 | Ding | |
| 6,006,985 | A | | 12/1999 | Hawkins | |
| 6,123,256 | A | * | 9/2000 | Landis | 229/311 |
| 7,178,713 | B2 | | 2/2007 | Stude | |
| 2005/0045707 | A1 | * | 3/2005 | Stude | 229/308 |

FOREIGN PATENT DOCUMENTS

| | | | |
|---|---|---|---|
| FR | 2728240 | A1 | 6/1996 |
| WO | WO 00/13977 | A1 | 3/2000 |

OTHER PUBLICATIONS

Office Action for Australian Application No. 2013200028; dated Aug. 2, 2013.

Extended European Search Report for corresponding European Application No. 12868569.0 dated Jul. 1, 2015, 4 pages.

* cited by examiner

EASY OPENING ENVELOPE

CROSS-REFERENCE TO RELATED APPLICATIONS

This application is a national stage application filed under 35 U.S.C. 371 of International Application No. PCT/AU2012/001264, filed Oct. 18, 2012, which claims priority from Australian Provisional Patent Application of number 2012900548, filed 15 Feb. 2012, now issued as Australian Patent No. 2013200028, the full content of each being incorporated by reference herein in their entireties.

BACKGROUND TECHNICAL FIELD

The present invention relates generally to envelopes, and more particularly to an envelope which can be easily opened.

BACKGROUND

The envelope has been an essential tool for communication throughout the last century. Millions of envelopes are opened each day in homes and offices around the world. It has long been acknowledged that the opening process of an envelope is an awkward procedure. To comfortably open an envelope a letter opener is required, however if one is not present, the problematic opening procedure often results in user causing damage to the envelope's content.

In recognition of this problem, there has been much prior effort focused on designing an envelope that attempts to simplify the opening process and offer unproblematic operation. Inventors created several types of easy opening envelopes that included the use of such innovations as envelopes with graspable tear-out tabs, cord pulling systems, and the use of perforations and rows of oblique cuts. For example, U.S. Pat. No. 7,178,713 (2007), U.S. Pat. No. 6,123,256 (2000), U.S. Pat. No. 6,006,985 (1999), U.S. Pat. No. 5,961,436 (1999), U.S. Pat. No. 5,505,376 (1996) and Canadian 2,187,509A1 (1996). However, these and other designs were not seen to be effective as a solution to the overall problem. The prior designs presented disadvantages to envelope's overall functionality or envelope's manufacturing cost.

All easy opening envelopes heretofore known suffer from either one or a combination of disadvantages that include:

(a) a lack of intuitive operation and straightforward usability;
(b) inability of one hand operation;
(c) decreased convenience, having detachable parts after opening;
(d) decreased reliability, no guarantee of a perfect result each time of opening;
(e) decreased durability, weakening envelope's overall structure;
(f) complexity of design, requiring significant altering of a standard manufacturing process for production; and
(g) no possibility of economical manufacturing with unavoidable excessive additional manufacturing costs.

For the foregoing reasons the earlier attempts of easy opening envelopes have failed to solve the problem. There thus remains a need for a simple envelope that can be economically manufactured, and can be easily opened and provide effortless removal of the envelope's content without functional drawbacks. It is against this background and the problems and difficulties associated therewith that the present invention has been developed.

SUMMARY

In accordance with the present invention an easy opening envelope comprises of a front panel and a rear panel, each having an upper edge, a lower edge and opposing side edges. A sealing flap connected to the upper edge of the front panel and an adhesive strip extending longitudinally across the envelope on either the sealing flap or the rear panel of the envelope. A continuing line of perforations extends from a corner section of the sealing flap towards the upper edge of the front panel, around the front panel towards the side edge of the front panel, and at or along a side fold line extending at the side edge of the front panel. Once the sealing flap is sealed by the adhesive strip to the rear panel, the envelope can be easily opened, by pulling on an edge of the corner section of the sealing flap along the continuing line of perforations to create an opening region in the envelope where a finger can be inserted to completely open the envelope by pushing the finger against the side fold line along the continuing line of perforations. A user can grasp content inside the envelope by utilising the created opened region and remove content from the envelope.

OBJECTS AND ADVANTAGES

Accordingly, several objects and advantages of the present invention are:

(a) to provide an easy opening envelope which will present intuitive operation and straightforward usability;
(b) to provide an easy opening envelope which can easily be opened with of one hand;
(c) to provide an easy opening envelope which will not decrease envelope's convenience and will not leave detachable parts after opening;
(d) to provide an easy opening envelope which will not decrease envelope's reliability and will guarantee a perfect result each time of operation;
(e) to provide an easy opening envelope which will not decrease envelope's durability, and will not weaken the overall structure of the envelope;
(f) to provide an easy opening envelope which will present simplicity of design, with no significant altering needed in regards to standard manufacturing; and
(g) to provide an easy opening envelope which can be produced at a low cost and be economically mass manufactured.

Further objects and advantages are:

to provide an easy opening envelope that at all times during operation makes it impossible to damage the content inside the envelope or cause injury to the individual;
to provide an easy opening envelope that does not require any tools for operation;
to provide an easy opening envelope which is equally easy to open with the left hand as it is with the right hand;
to provide an easy opening envelope that assists the user with the opening process and additionally assists the user to facilitate the removal process of the envelope's content.

Still further objects and advantages will become apparent from a consideration of the ensuing description and drawings.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF THE DRAWINGS

An illustrative embodiment of the present invention will be discussed with reference to the accompanying drawings wherein.

In the following description, like reference characters designate like or corresponding parts throughout the several views of the drawings.

REFERENCE NUMERALS IN DRAWINGS

20. Rear Panel
22. Upper Edge
24. Side Edge
26. Sealing Flap
28. Adhesive Strip
30. Corner of the Sealing Flap
32. Initial Part of the Continuing Line of Perforations
34. Second Part of the Continuing Line of Perforations
36. Third Part of the Continuing Line of Perforations
38. Front Panel
40. Side Adhesive Flap (1)
42. Side Adhesive Flap (2)

DESCRIPTION

Figure 1:
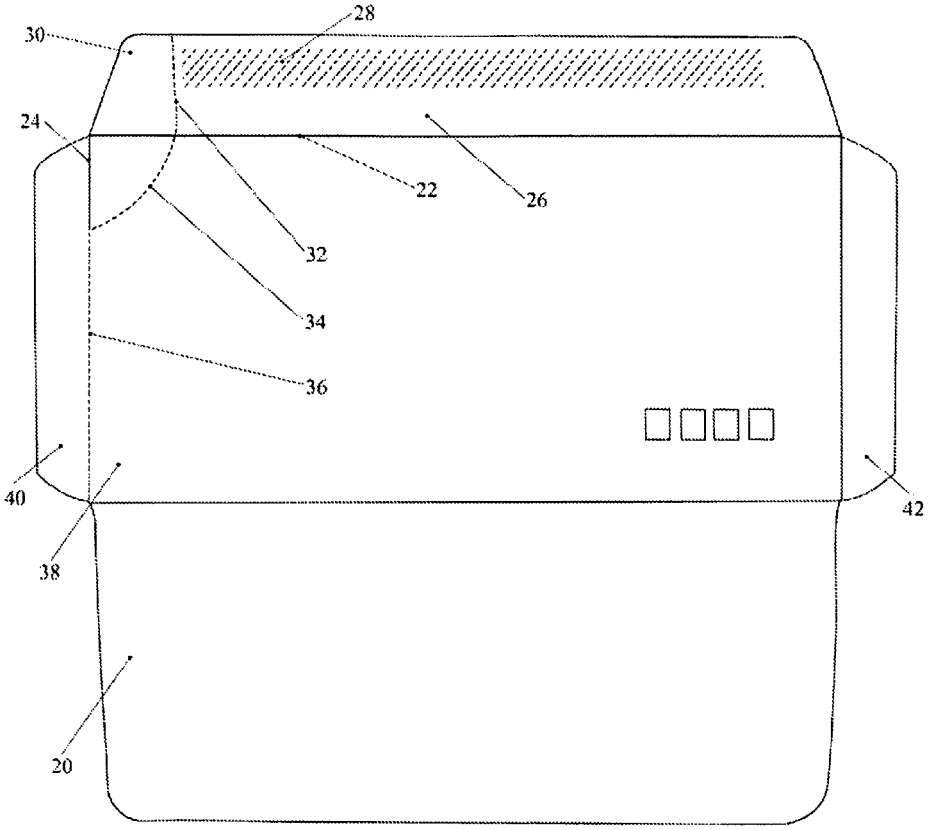
FIG. 1 is a plan view of the front side of an unfolded envelope illustrating the path of the continuing line of perforations.
Figure 2:
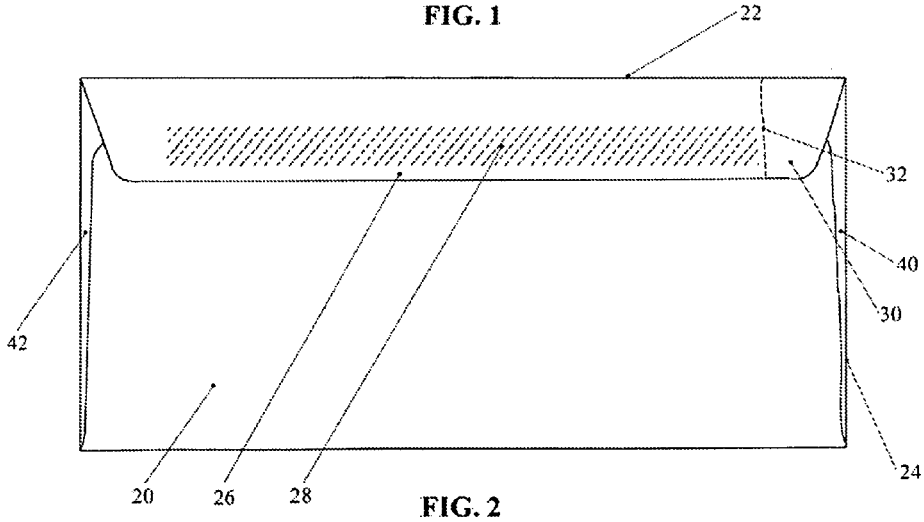
FIG. 2 is a plan view of the reverse side of the envelope when it is assembled, closed and sealed.

FIGS. 1, 2—Preferred Embodiment

A preferred embodiment of the easy opening envelope is illustrated in FIG. 1 which includes a body having, as is conventional, a front panel 38 and a rear panel 20, each of which has upper edges, lower edge and opposing side edges. Connected to an upper edge 22 of front panel 38 is a sealing flap 26, which includes an adhesive strip 28 along its lower part. Front panel 38 may, as conventional, include side adhesive flaps 40, 42, which in the assembled envelope are illustrated folded inwards and secured by an adhesive to rear panel 20 in FIG. 2. An intersection of side adhesive flap 40 and front panel 38 defines a side fold line on a side edge 24, as shown in FIG. 1.

In accordance with the present easy opening envelope, a continuing line of perforations 32, 34, 36 utilises a corner of the sealing flap 30, front panel 38 and the side fold line on side edge 24, as illustrated in FIG. 1. An initial part of the line of perforations 32 begins at a bottom edge of sealing flap 26 between corner of the sealing flap 30 and an edge of adhesive strip 28 in a non-adhesive spacing area. Initial part of the line of perforations 32 continues slightly curved in shape towards upper edge 22 over to front panel 38 and is connected to a second part of the line of perforations 34. Second part of line of perforations 34 continues from upper edge 22, round in shape, towards the side fold line on side edge 24. Second part of the line of perforations 34 is connected to a third part of the line of perforations 36. Third part of the line of perforations 36 is provided at or along the side fold line that is on side edge 24, at the intersection of side adhesive flap 40 and front panel 38. Third part of the line of perforations 36 follows from second part of the line of perforations 34 in a straight line towards a bottom corner of side edge 24.

Operation—FIGS. 3-7

Figure 3:
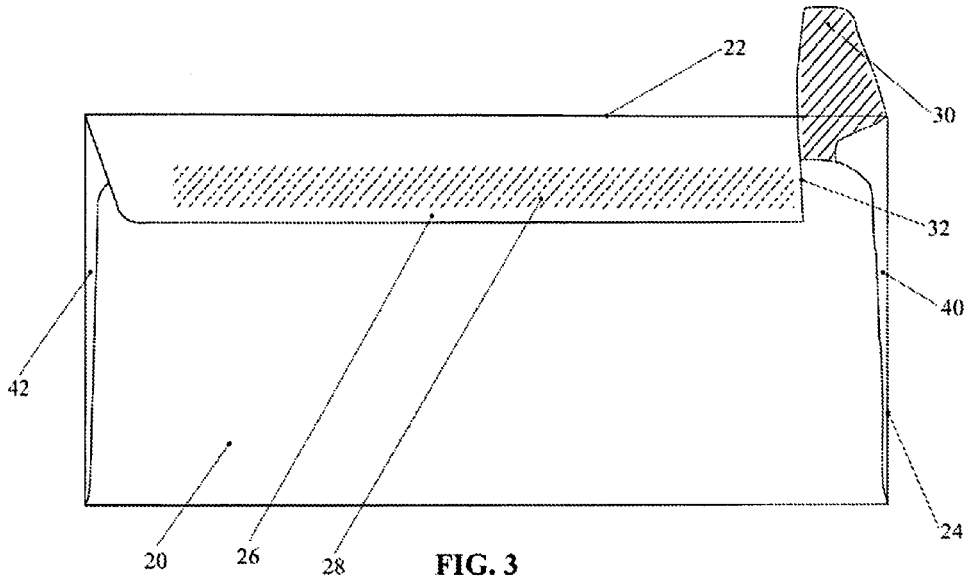
FIG. 3 is a plan view of the reverse side of the envelope illustrating an initial step in opening and unsealing the envelope.
Figure 4:
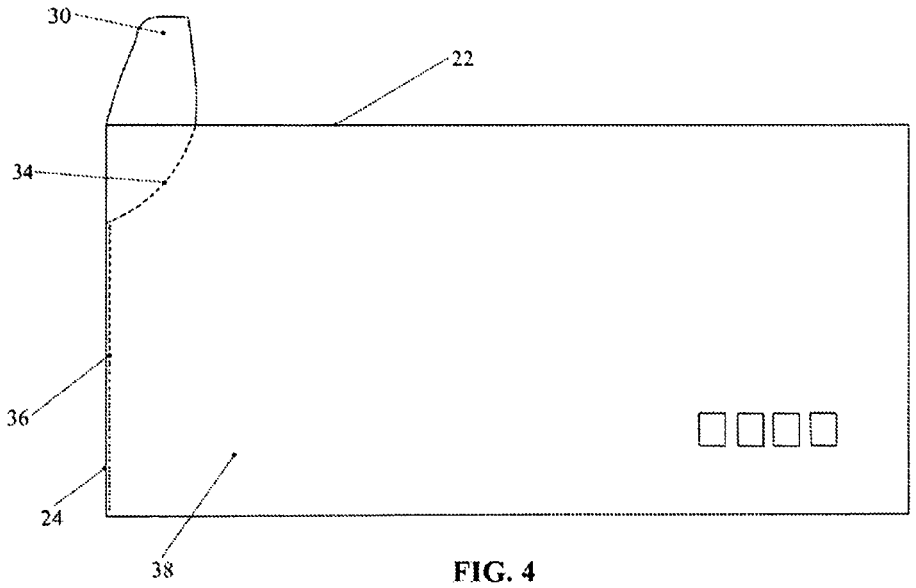
FIG. 4 is a plan view of the front side of the envelope of FIG. 3 illustrating the initial step in opening and unsealing the envelope.
Figure 5:
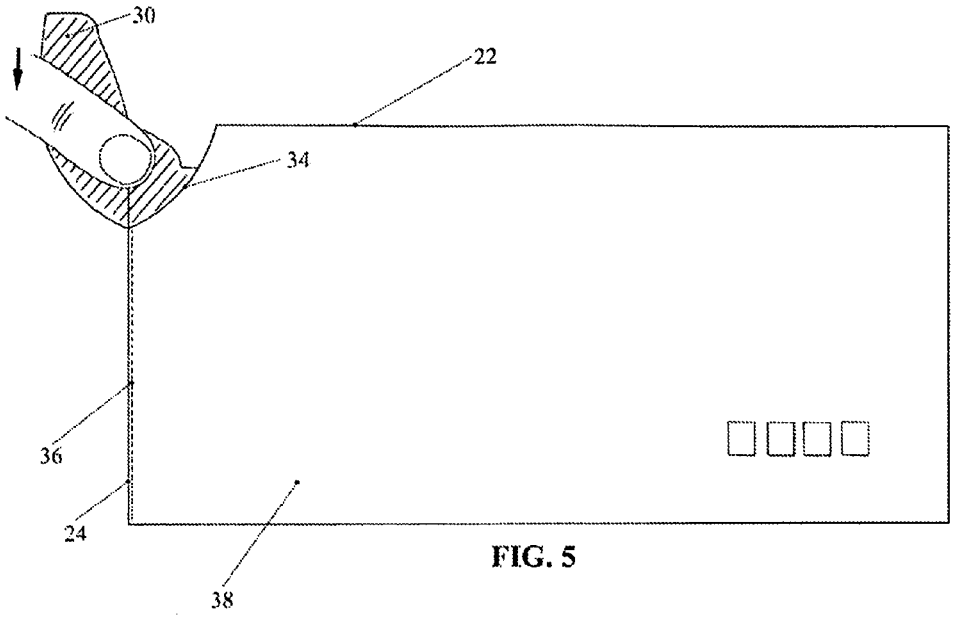
FIG. 5 is a plan view of the front side of the envelope illustrating the second and the third step in opening and unsealing the envelope.
Figure 6:
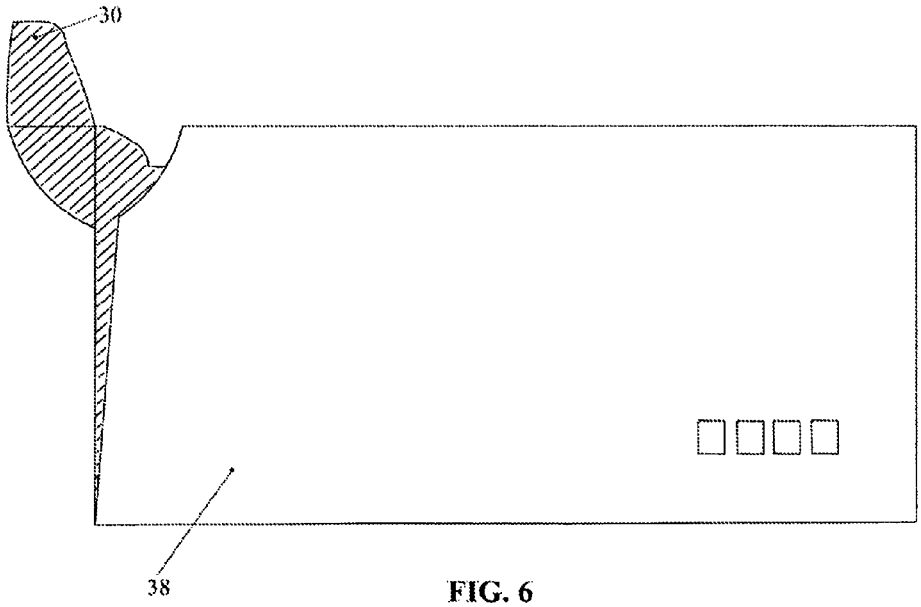
FIG. 6 is a plan view of the front side of the opened envelope after it is completely unsealed.
Figure 7:
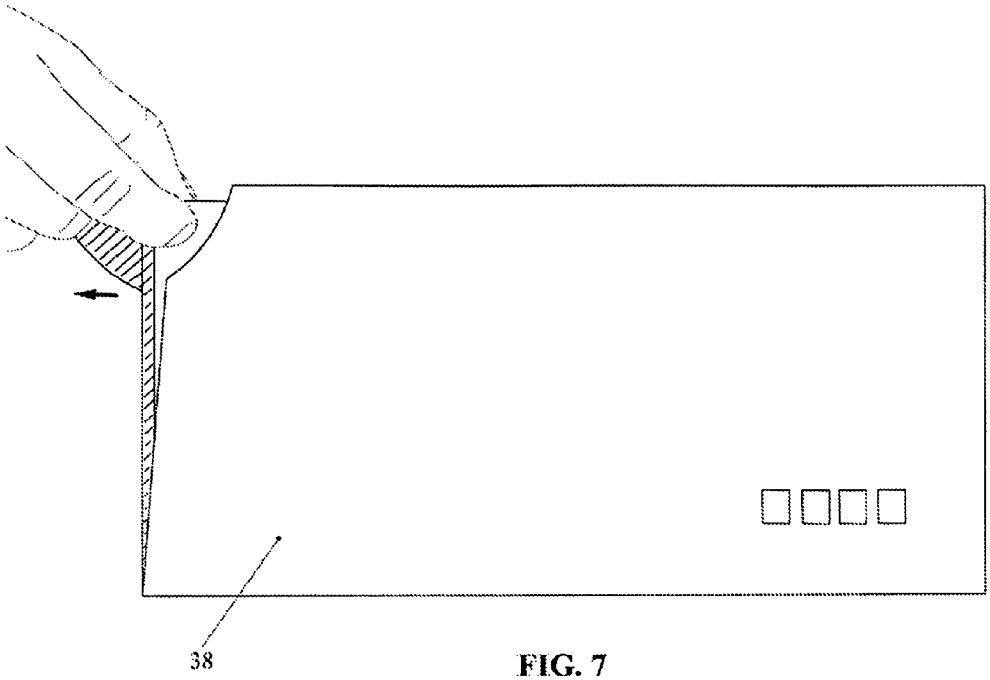
FIG. 7 is a plan view of the front side of the opened envelope illustrating the removal process of the envelope's content.

A user would grasp corner of the sealing flap 30 and pull up along initial part of the line of perforations 32 that begins at the bottom edge of sealing flap 26 between corner section of the sealing flap 30 and the edge of adhesive strip 28 in the non-adhesive spacing area, towards upper edge 22, as shown in FIGS. 3 and 4. The user would pull down and across corner of the sealing flap 30 along second part of the line of perforations 34, from upper edge 22 along front panel 38 towards the side fold line on side edge 24, as shown in FIG. 5. Thereby providing an opened region where a finger can be easily inserted into the envelope to enable the user to open the envelope. By pushing the finger against the side fold line on side edge 24 along third part of the line of perforations 36, which is provided at or along the side fold line at the intersection of side adhesive flap 40 and front panel 38 (FIG. 1), the envelope will be completely opened, as shown in FIG. 6. The user would grasp content inside the envelope by utilising the created opened region and remove content from the envelope, as shown in FIG. 7.

Figure 8:
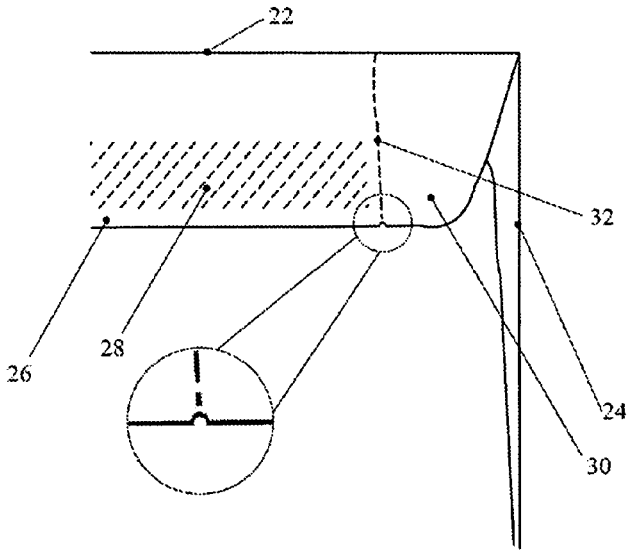
FIG. 8 is a detailed larger-scale plan view of the reverse side corner section of the envelope illustrating a small half a circle shape cut out from the corner of the sealing flap at the beginning of the line of perforations according to the additional embodiment of the invention.

Additional Embodiment—FIG. 8

Referring now to FIG. 8, which illustrates an additional embodiment of the easy opening envelope. A half a circle shape cut out sufficient in size to be larger then micro holes of continuing line of perforations 32, 34, 36 can be present at the beginning of initial part of the line of perforations 32. The half a circle shape cut out at the beginning of initial line of perforations 22 can add additional assistance for the opening process and provide significant protection to make sure that the envelope can only be intentionally opened.

Figure 9:
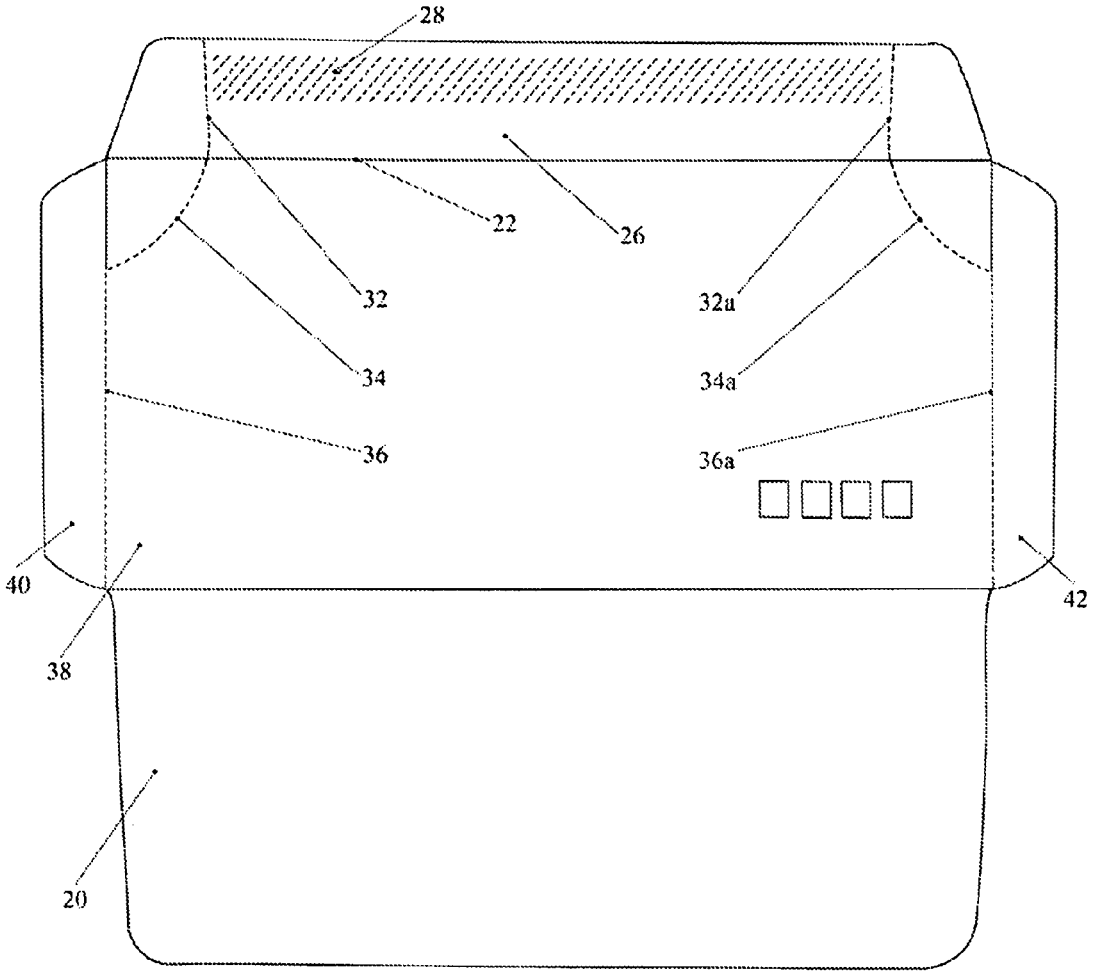
FIG. 9 is a plan view of the front side of an unfolded envelope illustrating two paths of the continuing lines of perforations according to the second embodiment of the invention.
Figure 10:
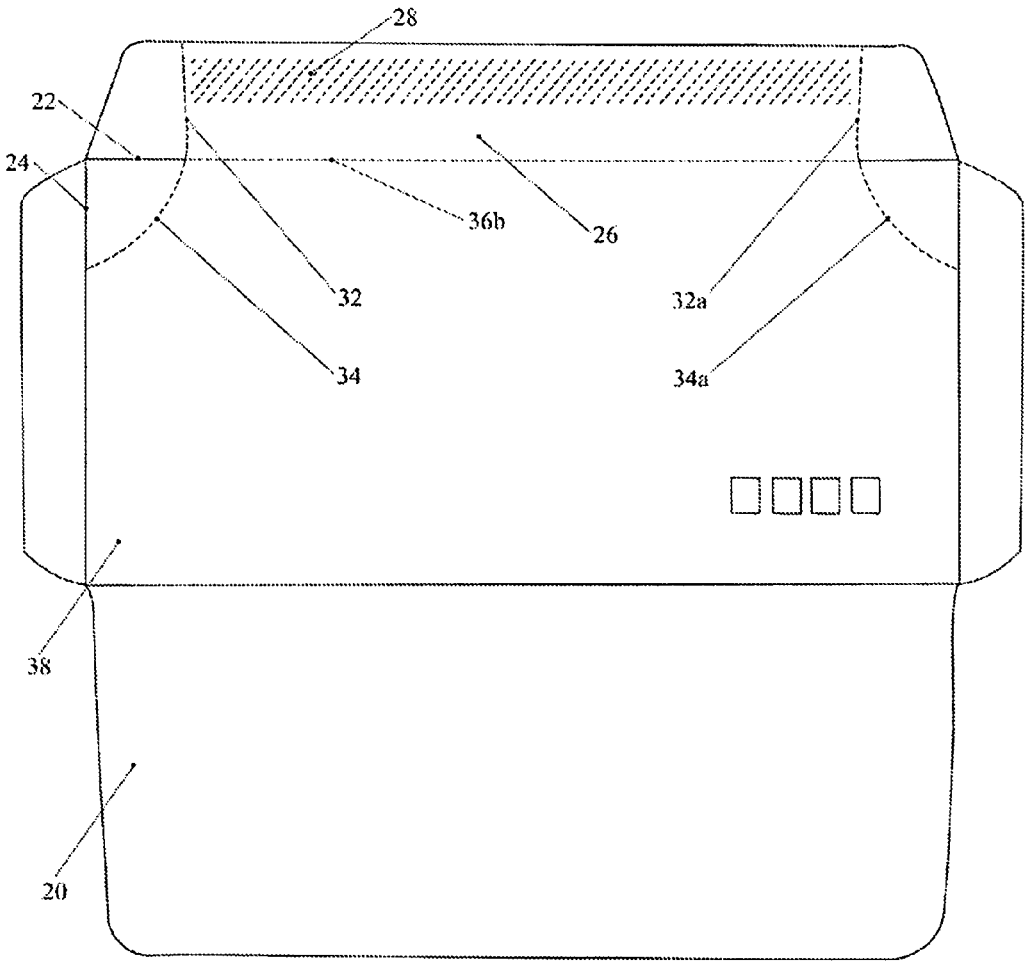
FIG. 10 is a plan view of the front side of an unfolded envelope illustrating alternative paths of the continuing lines of perforations according to the third embodiment of the invention.

Alternative Embodiments—FIG. 9-FIG. 10

Further, in the embodiment of the invention illustrated in FIG. 9 continuing line of perforations 32, 34, 36 can be placed identically mirrored on an opposite side of the envelope. Where two continuing lines of perforations 32, 34, 36 and 32*a*, 34*a*, 36*a* can utilise both corners of sealing flap 26, front panel 38, and the side fold lines on the two side edges of front panel 38. Two initial parts of the lines of perforations 32 and 32*a* begin at the two opposite side bottom edges of sealing flap 26 between the corner sections of sealing flap and the edges of adhesive strip 28, in the non-adhesive spacing areas. Two initial parts of the lines of perforations 32 and 32*a* continue slightly curved in shape towards upper edge 22, over to front panel 38 towards second parts of the two lines of perforations 34 and 34*a*. Second parts of the two lines of perforations 34 and 34*a*, round in shape, continue from upper edge 22 towards the side fold lines on the side edges of front panel 38. Third parts of the two lines of perforations 36 and 36*a* are provided at or along the side fold lines at the intersection of side adhesive flap 40 and front panel 38, and at an intersection of side adhesive flap 42 and front panel 38. The two identically mirrored continuing lines of perforations end at the bottom of corners of the side edges of front panel 38.

The user would grasp any of the two corners of the sealing flap and perform the same opening action as indicated in the operation of the preferred embodiment at any of the two sides of the envelope (not shown).

Further, in the embodiment of the invention illustrated in FIG. 10 the initial and second parts of continuing lines of perforations 32, 34 can be placed identically mirrored on the opposite side of the envelope. Two continuing lines of perforations 32, 34 and 32*a*, 34*a* can utilise both corners of sealing flap 26 and front panel 38. A third part of the two lines of perforations 36*b* can utilise a fold line on upper edge 22 of front panel 38. Two initial parts of the lines of perforations 32 and 32*a* begin at the two opposite side bottom edges of sealing flap 26 between the corner sections of sealing flap and the edges of adhesive strip 28, in the non-adhesive spacing areas. Two initial parts of the lines of perforations 32 and 32*a*, slightly curved in shape, continue towards upper edge 22, over to front panel 38 towards second parts of the two lines of perforations 34 and 34*a*.Second parts of the two lines of perforations 34 and 34*a*, round in shape, continue from upper edge 22 towards the side fold lines on the side edges of front panel 38. Third part of the two lines of perforations 36*b* is provided at or along the fold line at an intersection of sealing flap 26 and front panel 38 on upper edge 22 of front panel 38. Third part of the two lines of perforations 36*b* connects together two continuing lines of perforations 32, 34 and 32*a*, 34*a*.

The user would grasp the corner of the sealing flap and pull up along initial part of the line of perforations 32 that begins at the bottom edge of sealing flap 26 between the corner section of the sealing flap and the edge of adhesive strip 28 in the non-adhesive spacing area, towards upper edge 22. The user would pull down and across the corner of the sealing flap along second part of the line of perforations 34, from upper edge 22 along front panel 38 towards the side fold line on side edge 24. Thereby providing the opened region where the finger can be easily inserted into the envelope. The user would repeat these steps on the opposite side of the envelope and follow the continuing lines of perforations 32*a*, 34*a* to provide a second opened region where the finger can be easily inserted into the envelope to enable the user to open the envelope. Utilising one of the two opened regions, by pushing the finger against the fold line on upper edge 22 along third part of the line of perforations 36*b*, which is provided at or along the fold line at the intersection of sealing flap 26 and front panel 38, the envelope will be completely opened. The user would grasp content inside the envelope by utilising the created opened regions and remove content from the envelope (not shown).

Alternatively, continuing line of perforations 32, 34, 36, the two continuing lines of perforations 32, 34, 26 and 32*a*, 34*a*, 36*a*, the two continuing lines of perforations 32, 34 and 32*a*, 34*a* or the third part of line of perforations 36*b* can be formed with a line of micro cuts that can similarly direct the user to tear along the given path to easily open the envelope and remove its content (not shown).

Although the present easy opening envelope has been described in considerable detail with reference to certain preferred versions thereof, other versions are possible. Therefore, the spirit and scope of the claims should not be limited to the description of the preferred versions contained therein.

ADVANTAGES

From the description above, a number of advantages of the easy opening envelope become evident. It is clear that the easily opening envelope can not only be manufactured as described in the embodiments. The continuing line/lines of perforations present in the easily opening envelope can be easily added to most standard envelope models. This can be done with the puncher during the manufacturing process at the time when the unfolded envelope sheets are separated for printing or other purposes. The exact measurements of the continuing line/lines of perforations can be adjusted to reflect the specific envelope model. With this extra step added into the standard envelope manufacturing process, it will be possible, without functional drawbacks, to economically include easy opening functionality to most standard envelope models.

In addition, it is evident that the embodiment of the invention in FIG. 10 is especially beneficial for larger envelope models that are sealed along the shorter side of the envelope. For example, such envelope models usually come in greater than standard sizes to cater for A4 and larger sizes of unfolded paper documents.

CONCLUSION, RAMIFICATIONS, AND SCOPE

Accordingly, the reader will see that the easy opening envelope of this invention provides an easy opening envelope that can be economically manufactured and which can, without functional drawbacks, be easily opened and provide effortless removal of the envelope's content. In addition, the easy opening envelope presents an easy opening process that at all times during operation makes it impossible to damage the content inside the envelope or cause injury to the individual. As well as, provides an easy opening envelope that can be altered to accommodate the size and model types of envelopes and to provide easy opening functionality to existing standard envelope models without functional drawbacks.

Furthermore, the easy opening envelope has the additional advantages in that:

(a) it provides an easy opening envelope with superior intuitive operation and straightforward usability;
(b) it provides an easy opening envelope which can be easily opened with of one hand;
(c) it provides an easy opening envelope which does not decrease envelope's convenience and does not leave detachable parts after opening;
(d) it provides an easy opening envelope which does not decrease envelope's reliability and guarantees a perfect result each time of operation;
(e) it provides an easy opening envelope which does not decrease envelope's durability and does not weaken the overall structure of the envelope;
(f) it provides an easy opening envelope which presents simplicity of design, with no significant altering needed in regards to standard manufacturing; and
(g) it provides an easy opening envelope which can be produced at a low cost and be economically mass manufactured.

It will be understood that the term "comprise" and any of its derivatives (eg. comprises, comprising) as used in this specification is to be taken to be inclusive of features to which it refers, and is not meant to exclude the presence of any additional features unless otherwise stated or implied.

The reference to any prior art in this specification is not, and should not be taken as, an acknowledgement of any form of suggestion that such prior art forms part of the common general knowledge.

Although the description above contains many specificities, these should not be construed as limiting the scope of the invention but as merely providing illustrations of some of the presently preferred embodiments of this invention. For example, the envelope structure can be of other types according to different envelope models and the continuing line/lines of perforations can have other shapes, such as oval, triangular, etc. Thus the scope of the invention should be determined not by the embodiments illustrated, but by the appended claims and their legal equivalents.

What is claimed is:

1. An envelope comprising:

a front panel and a rear panel, each having an upper edge, a lower edge and opposing side edges, where said front and rear panels are connected at said lower edge of said front panel;

a sealing flap connected to said upper edge of said front panel;

an adhesive strip extending longitudinally across said envelope on one of said sealing flap or said rear panel of said envelope;

a continuing line of perforations extending from at or near a corner section of said sealing flap towards said upper edge of said front panel, then from said sealing flap around said upper edge of said front panel to said front panel, then along said front panel towards said side edge of said front panel, and then at or along said side edge of said front panel towards said lower edge of said front panel;

wherein in use, once said sealing flap is sealed by said adhesive strip to said rear panel, said envelope can be opened, by pulling on said corner section of said sealing flap and along said continuing line of perforations to create an opening region in said envelope, into which a finger can be inserted to completely open said envelope by pushing said finger against said side fold line along said continuing line of perforations, and wherein the corner section of the sealing flap is connected to the rear panel via a portion of the side edge of the front panel such that the corner section is configured to remain attached to the envelope when the continuing line of perforations is opened.

2. The easy opening envelope of claim 1, further including a predetermined half a circle shape cut out sufficient in size to enhance the opening process at the beginning of said continuing line of perforations.

3. The easy opening envelope of claim 1, wherein said continuing line of perforations is formed with a line of micro cuts.

4. The easy opening envelope of claim 1, wherein said continuing line of perforations is placed identically mirrored on two sides of the envelope.

5. The easy opening envelope of claim 1, wherein said adhesive strip extends outside but not within said corner section of said sealing flap confined by said continuing line of perforations.

6. The easy opening envelope of claim 1, wherein the corner section is connected to the rear panel via a side adhesive flap.

7. The easy opening envelope of claim 1, wherein the envelope is configured to receive at least a portion of a letter between the corner section of the sealing flap and a portion of the front panel defined on a same side of the continuing line of perforations as the corner section.

8. The easy opening envelope of claim 1, wherein the portion of the continuing line of perforations extending along said side edge of said front panel towards said lower edge of said front panel extends to the lower edge of said front panel.

9. The easy opening envelope of claim 1, wherein the portion of the continuing line of perforations extending towards said side edge of said front panel extends to a point on the side edge of said front panel.

10. The easy opening envelope of claim 9, wherein the portion of the continuing line of perforations extending along said side edge of said front panel towards said lower edge of said front panel extends from the point on the side edge of said front panel towards the lower edge of the front panel.

* * * * *